US008646288B2

(12) United States Patent
Lim et al.

(10) Patent No.: US 8,646,288 B2
(45) Date of Patent: Feb. 11, 2014

(54) REFRIGERATOR WITH WATER DISPENSER

(75) Inventors: Jae Hoon Lim, Suwon-si (KR); Sung Il Park, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 895 days.

(21) Appl. No.: 12/071,798

(22) Filed: Feb. 26, 2008

(65) Prior Publication Data

US 2008/0202147 A1 Aug. 28, 2008

(30) Foreign Application Priority Data

Feb. 26, 2007 (KR) ..... 10-2007-0019114

(51) Int. Cl.
*F25D 3/00* (2006.01)

(52) U.S. Cl.
USPC ..... 62/389; 222/146.6

(58) Field of Classification Search
USPC ..... 62/389; 222/146.6
See application file for complete search history.

(56) References Cited

U.S. PATENT DOCUMENTS 5,526,854 A * 6/1996 Unger ..... 141/351
6,810,682 B1 * 11/2004 Schuchart et al. ..... 62/98
7,188,487 B2 * 3/2007 Choi ..... 62/389

FOREIGN PATENT DOCUMENTS

KR 1997-0047681 7/1997

* cited by examiner

*Primary Examiner* — Cheryl Tyler
*Assistant Examiner* — Lakiya Rogers
(74) *Attorney, Agent, or Firm* — Staas & Halsey LLP

(57) ABSTRACT

A refrigerator including a dispenser to extract water is disclosed. The refrigerator includes a main body having a storage chamber, a door opening and closing the storage chamber, and a dispenser disposed to discharge water, the dispenser including a button installed to be movable in a backward and forward moving direction, a switch pressed to cause water to be discharged, and a lever rotatably installed sideward with respect to the forward/backward moving direction of the button having one end disposed at a rear side of the button and an other end disposed on the switch and performing a seesaw movement sideward as the button moves in the forward/backward moving direction to press the switch. Thus, the dispenser can be formed to have a small thickness in a forward/backward direction.

7 Claims, 4 Drawing Sheets

REFRIGERATOR WITH WATER DISPENSER

CROSS-REFERENCE TO RELATED APPLICATIONS

This application claims the benefit of Korean Patent Application No. 2007-0019114, filed on Feb. 26, 2007 in the Korean Intellectual Property Office, the disclosure of which is incorporated herein by reference.

BACKGROUND

1. Field

The present invention relates to a refrigerator, and, more particularly, to a refrigerator including a dispenser to extract water.

2. Description of the Related Art

Generally, a refrigerator is an apparatus which supplies cool air generated by a refrigeration cycle to a storage chamber which stores food such that various storage products can be stored while being cooled or frozen. A conventional refrigerator, as disclosed in Korean Patent Laid-open Publication No. 10-1997-47681, includes a main body which has a storage chamber, a door which opens and closes the storage chamber, an ice maker which makes ice, a dispenser disposed to extract water and ice at the outside, etc.

The dispenser includes a discharge line which discharges water, a lever which is rotatably installed in a forward/backward direction to perform a seesaw movement in a forward/backward direction, a switch which is pressed by the lever performing a seesaw movement to discharge water through the discharge line, etc. When a lower end of the lever is pressed by a container to be supplied with water, etc., the upper end of the lever presses the switch while the lever performs a seesaw movement to discharge water through the discharge line.

In the conventional refrigerator, since the lever performs a seesaw movement in a forward/backward direction to press the switch, the dispenser should have a specified or larger space such that the lever can perform a seesaw movement in a forward/backward direction. Accordingly, the dispenser applied to the conventional refrigerator should be thickly formed to have a specified or greater thickness.

Recently, in the refrigerator including the dispenser, the dispenser may be installed on one side wall of the storage chamber instead of the door to simplify the design. When the above-mentioned dispenser having a large thickness is installed on the sidewall of the storage chamber, the dispenser is installed to be protruded toward an inside of the storage chamber, thereby causing a problem such that the inner space of the storage chamber is reduced by the dispenser.

SUMMARY

The present embodiment has been made in order to solve the above problems. It is an aspect of the embodiment to provide a refrigerator capable of efficiently using an inner space of a storage chamber by forming a dispenser to have a small thickness.

Additional aspects and/or advantages will be set forth in part in the description which follows and, in part, will be apparent from the description, or may be learned by practice of the invention.

In accordance with an aspect of the invention, there is provided a refrigerator, including: a main body having a storage chamber, a door opening and closing the storage chamber and a dispenser disposed to discharge water, the dispenser including a button installed to be movable in a backward and forward moving direction, a switch pressed to cause water to be discharged, and a lever rotatably installed sideward with respect to the forward/backward moving direction of the button having one end disposed at a rear side of the button and an other end disposed on the switch and performing a seesaw movement sideward as the button moves in the forward/backward moving direction to press the switch.

The dispenser may be installed on a side wall of the storage chamber, and the button is installed to be movable in backward and forward directions toward the side wall of the storage chamber.

The dispenser may include a case having an open front surface toward an inner side of the storage chamber and an accommodating portion accommodating the lever and the switch, and a cover covering the front surface of the case, the button being installed at the cover to move backward and forward.

The dispenser may include a cam projection having a slanted surface formed at one of the button and the lever to rotate the lever sideward as the button moves backward.

A discharge part may be formed at the cover and recessed backward such that a portion of a container to be supplied with water is able to enter into the discharge part, the button may be installed at the discharge part, and a discharge line may be installed at an upper side of the button of the discharge part to discharge water.

In accordance with another aspect of the invention, there is provided refrigerator, including: a main body having a storage chamber to store food; a dispenser installed on a wall of the storage chamber, and having a discharge part formed to be recessed in the dispenser such that a container to be supplied with water is able to enter into the discharge part; a discharge line installed at an upper side of the discharge part to discharge water; and a button installed at a lower side of the discharge line of the discharge part and pressable by the container entering into the discharge part to move backward toward the wall of the storage chamber.

The dispenser may include a switch pressed to discharge water through the discharge line, and a lever rotatably installed sideward with respect to a forward/backward moving direction of the button having one end disposed at a rear side of the button and the other end disposed on the switch and performing a seesaw movement sideward as the button moves back and forth to press the switch.

The dispenser may include a case having an open front surface toward the storage chamber and an accommodating portion to accommodate the lever and the switch, and a cover which covers the front surface of the case and is provided with the discharge part.

The refrigerator may further include a discharge line discharging water when the lever presses the switch, the pressing of the switch causing the water to be discharged.

The dispenser may be installed on a side wall of the refrigerator.

The foregoing and/or other aspects are achieved by providing a dispenser for a refrigerator, including: a button having a backward/forward moving direction; a lever having a sideward moving direction with respect to the backward/forward moving direction and moving in the sideward moving direction when the button is depressed; and a switch causing water to be discharged when the switch is pressed by the lever moving in the sideward moving direction.

The lever may perform a seesaw movement in the sideward moving direction.

The dispenser may include a cam projection in communication with the button, the cam projection abutting against the lever and causing the lever to move in the sideward moving direction when the button is depressed.

The dispenser may include a discharge line to discharge the water, the discharge line discharging water when the switch is pressed by the lever.

The foregoing and/or other aspects are achieved by providing a refrigerator, including: a main body having a storage chamber to cool food; a button having a backward/forward moving direction; a lever having a sideward moving direction with respect to the backward/forward moving direction and moving in the sideward moving direction when the button is depressed; and a switch causing water to be discharged when the switch is pressed by the lever moving in the sideward moving direction.

The refrigerator may further include a discharge line to discharge the water, the discharge line discharging water when the switch is pressed by the lever.

BRIEF DESCRIPTION OF THE DRAWINGS

These and/or other aspects and advantages will become apparent and more readily appreciated from the following description of the embodiment, taken in conjunction with the accompanying drawings, of which.

DETAILED DESCRIPTION OF THE EMBODIMENTS

Figure 1:
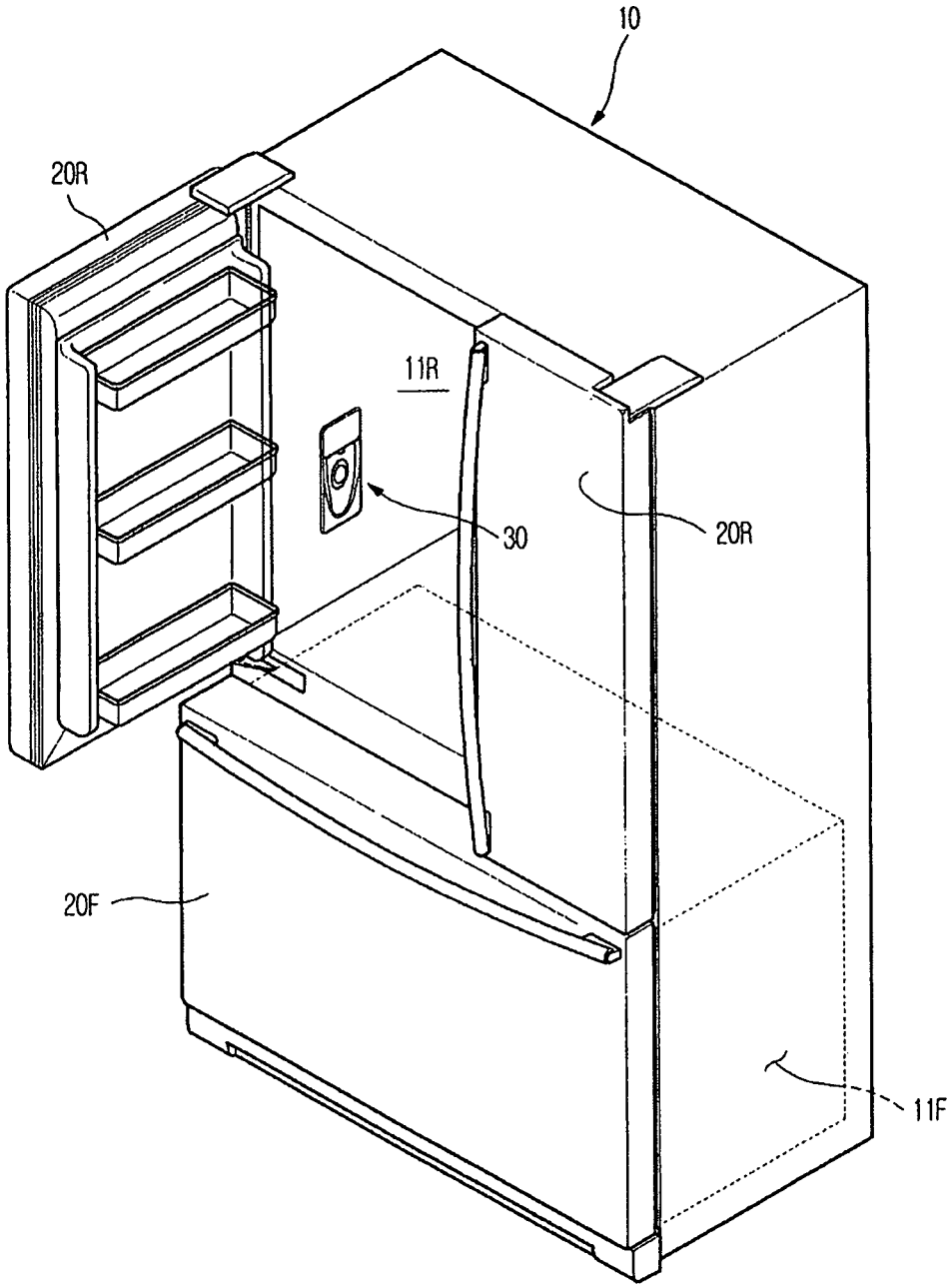
FIG. 1 illustrates a perspective view of a refrigerator according to the present embodiment.

Reference will now be made in detail to an embodiment, examples of which are illustrated in the accompanying drawings, wherein like reference numerals refer to like elements throughout. The embodiment is described below to explain the present invention by referring to the figures.

Hereinafter, an embodiment will be described in detail with reference to the accompanying drawings.

Figure 2:
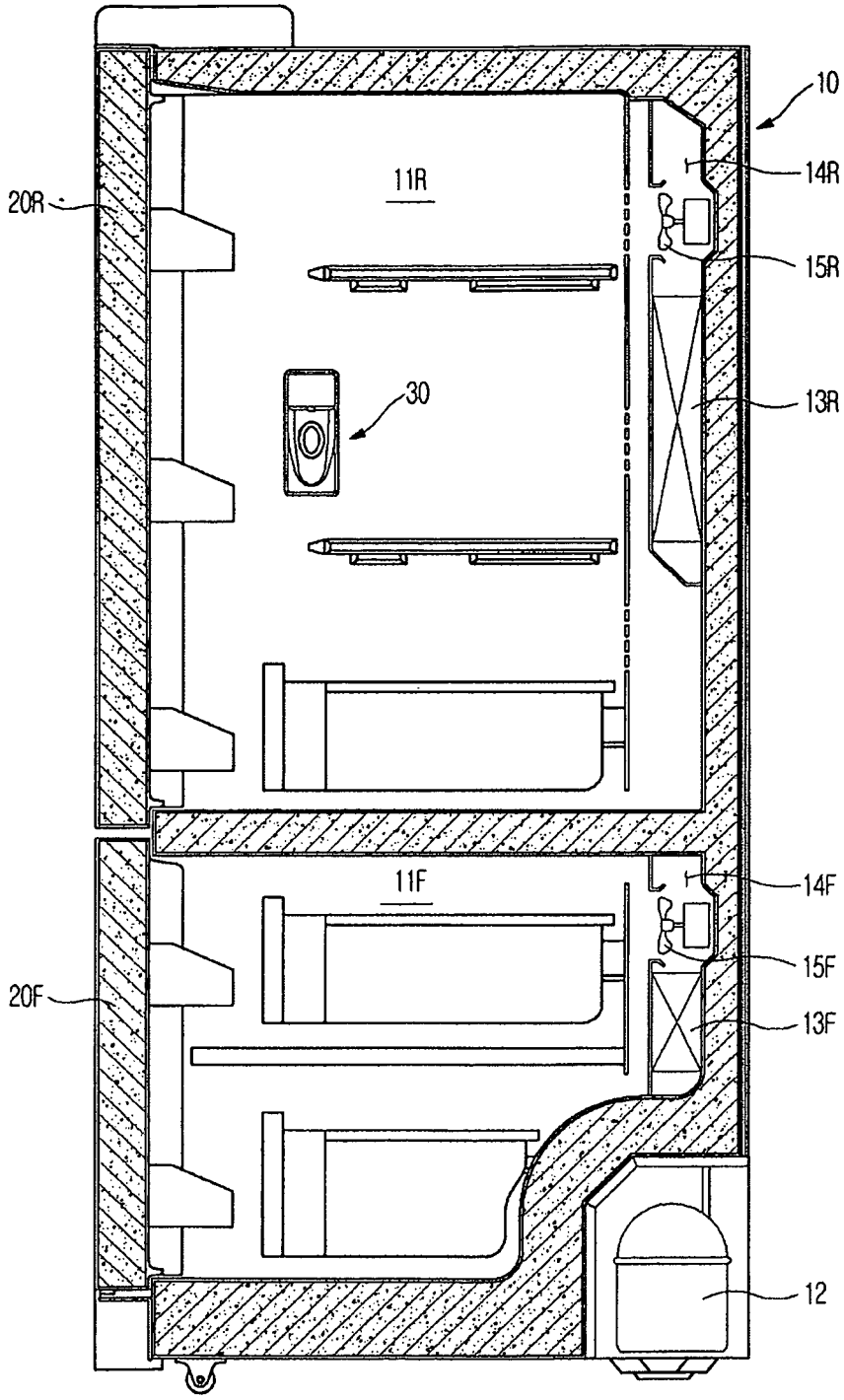
FIG. 2 illustrates a side cross-sectional view schematically showing an inner configuration of the refrigerator according to the present embodiment.

As shown in FIGS. 1 and 2, a refrigerator according to the present embodiment includes a main body 10 which has storage chambers 11R and 11F to store food and doors 20R and 20F which are hinge-coupled to one side of the main body 10 to open and close the storage chambers 11R and 11F.

The storage chambers 11R and 11F include an upper compartment and a lower compartment separated by an intermediate partition wall, wherein the upper compartment forms a cooling chamber 11R which cools and stores food and the lower compartment forms a freezing chamber 11F which freezes and stores food. The doors 20R and 20F include a cooling chamber door 20R which opens and closes the cooling chamber 11R and a freezing chamber door 20F which opens and closes the freezing chamber 11F to separately open and close the cooling chamber 11R and the freezing chamber 11F.

A compressor 12 is installed at a lower rear side of the main body 10 to compress a coolant. A cooling evaporator chamber 14R and a freezing evaporator chamber 14F are disposed at a rear side of the cooling chamber 11R and the freezing chamber 11F to install a cooling evaporator 13R and a freezing evaporator 13F which generate cool air to be supplied to the cooling chamber 11R and the freezing chamber 11F, respectively. Further, a cooling circulation fan 15R and a freezing circulation fan 15F, which are rotated to generate a suction force and an air blowing force, are arranged at the cooling evaporator chamber 14R and the freezing evaporator chamber 14F such that the cool air generated in the cooling evaporator 13R and the freezing evaporator 13F circulates into the cooling chamber 11R and the freezing chamber 11F, respectively.

Figure 3:
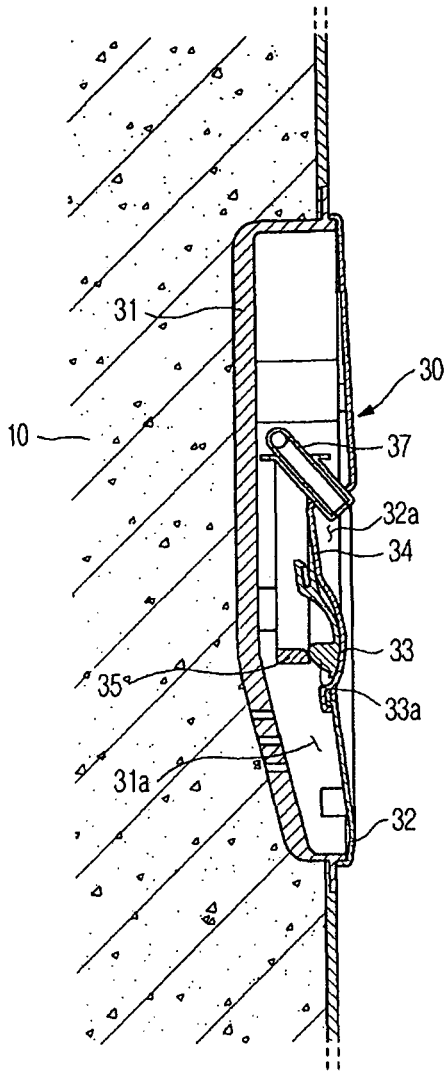
FIG. 3 illustrates a cross-sectional view showing an inner configuration of a dispenser applied to the refrigerator according to the present embodiment.
Figure 4:
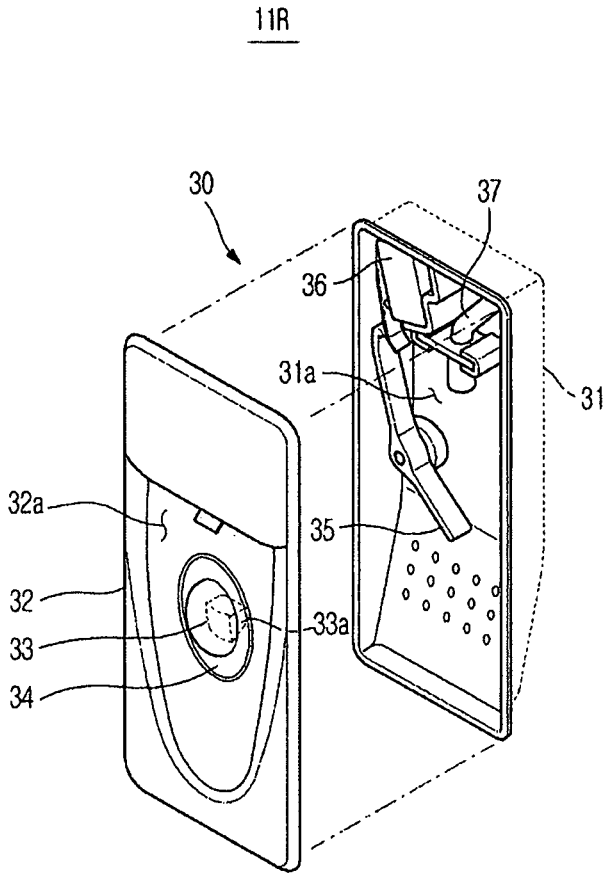
FIG. 4 illustrates a perspective view showing the inner configuration of the dispenser applied to the refrigerator according to the present embodiment.

Further, in the refrigerator according to the present embodiment, a dispenser 30 is disposed on one side wall, for example, of the storage chambers 11R and 11F to extract water. As shown in FIGS. 3 and 4, the dispenser 30 includes a discharge line 37 which discharges water, a button 33 which is installed to be movable back and forth toward one side wall of the storage chambers 11R and 11F, a switch 36 which is pressed and operates a valve (not shown), a pump (not shown) or the like disposed in the refrigerator to discharge water through the discharge line 37, and a lever 35 which has one end disposed at a rear side of the button 33, the other end disposed on the switch 36 and a middle portion rotatably installed in the dispenser 30 and performing a seesaw movement sideward with respect to a moving direction of the button 33 as the button 33 moves back and forth, that is, in a forward/backward direction on the basis of the main body 10 to press the switch 36.

In this case, the lever 35 applied to the refrigerator according to the present embodiment is rotatably installed sideward with respect to the back and forth moving direction of the button 33 and performs a seesaw movement sideward to press the switch 36. As described above, when the lever 35 is rotatably installed sideward with respect to the back and forth moving direction of the button 33, although the dispenser 30 is formed to have a thickness slightly larger than a thickness of the lever 35, the lever 35 can be smoothly operated. Accordingly, the dispenser 30 can be formed to have a small thickness by rotatably installing the lever 35 sideward with respect to the back and forth moving direction of the button 33.

In order to rotate the lever 35 by the button 33, a cam projection 33*a* is disposed at the button 33 to be protruded backward and transmits an external force applied by a user to the lever 35 such that the lever 35 performs a seesaw movement sideward with respect to the back and forth moving direction of the button 33. The cam projection 33*a* has a lower surface which may be a slanted surface inclined toward an upper rear side of the cam projection 33*a*. Accordingly, as an external force is applied to the button 33 and the button 33 moves backward toward one side wall of the storage chambers 11R and 11F, one end of an upper surface of the lever 35 moves downward along the slanted surface disposed at the cam projection 33*a*. Consequently, the lever 35 is rotated sideward with respect to the back and forth moving direction of the button 33. As the lever 35 is rotated sideward, the other end of the lever 35 presses the switch 36 to discharge water through the discharge line 37.

Further, in order to install the above-described components, the dispenser 30 includes a case 31 which has an open front surface opened toward the storage chambers 11R and 11F and an accommodating portion 31*a* to accommodate the switch 36 and the lever 35 therein, and a cover 32 which covers the front surface of the case 31. The button 33 is installed at the cover 32 to move back and forth in a forward/backward direction. The switch 36 is installed at an inner upper side of the case 31, and the lever 35 is rotatably installed at the lower side of the switch 36. One end of the lever 35 is disposed at the rear side of the button 33 and the other end of the lever 35 is extended upward to be disposed on the side of the switch 36. Further, in this embodiment, the button 33 is installed at the cover 32 through an elastic member 34 formed of a material, such as rubber, for example, capable of being elastically deformed. The button 33 moves backward by an external force applied by the user to move the lever 35 downward. If the external force which is applied to the button 33 is removed, the button 33 moves forward by an elastic restoration force of the elastic member 34 and returns to an original position. Also, the upper end of the lever 35 rotates away from the switch-engaging position sideways when the external force which is applied to the button 33 is removed.

A discharge part 32*a* is formed at a lower portion of the cover 32 to be recessed backward such that a portion of a container to be supplied with water can enter into the discharge part 32*a*. The above-described button 33 is disposed at the discharge part 32*a*. The above-described discharge line 37 is disposed at the upper side of the button 33 of the discharge part 32*a*. Accordingly, since water is discharged from the discharge line 37 disposed at the upper side of the button 33, the button 33 may be pressed by the container while the container is held with one hand, thereby easily and conveniently extracting water.

Although the cam projection 33*a* is formed to be protruded backward from the button 33 in the embodiment, the cam projection with a slanted surface may be formed at the lever 35 without being limited thereto.

As described above, in the dispenser applied to the refrigerator according to the present embodiment, the lever performs a seesaw movement sideward to press the switch. Thus, the dispenser can be formed to have a small thickness, thereby efficiently using an inner space of the storage chamber.

Further, in the refrigerator according to the present embodiment, the discharge line is disposed at the upper side of the button, and the button is pressed by the container to be supplied with water to discharge water through the discharge line. Thus, it is also possible to easily extract water with one hand.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A refrigerator, comprising:

a main body having a storage chamber;

a door opening and closing the storage chamber; and a dispenser installed on an inner side wall of the storage chamber to be accessible as the door is open, the dispenser including a switch controlling a discharge of water, a button with a cam projection having a slanted surface to activate the switch by moving from an interior of the storage chamber toward the inner side wall of the storage chamber, a lever performing a seesaw movement on a plane perpendicular to a moving direction of the button to press the switch as the button moves from the interior of the storage chamber toward the inner side wall of the storage chamber, a case having an open front surface and an accommodating portion accommodating the switch, a cover covering the open front surface of the case, and a discharge part at the cover and recessed backward such that a portion of a container to be supplied with water is able to enter into the discharge part, an elastic member surrounding an outer periphery of the button and connecting the button to the cover, the elastic member being co-planar with the cover, whereby removing an internal force applied to the button moves the button toward an interior of the storage chamber, wherein the accommodating portion is located between a flat inner side wall and a flat outer side wall of the storage chamber.

2. The refrigerator according to claim 1, wherein the cam projection rotates the lever sideward as the button moves from the interior of the storage chamber toward the inner side wall of the storage chamber.

3. The refrigerator according to claim 1, wherein the lever is rotatably installed sideward with respect to a moving direction of the button and has one end disposed at a rear side of the button and an other end disposed on the switch and performs a seesaw movement sideward as the button moves from the interior of the storage chamber toward the inner side wall of the storage chamber.

4. A dispenser for a refrigerator including a main body having a storage chamber, and a door opening and closing the storage chamber, the dispenser comprising:

a switch controlling a discharge of water;

a button activating the switch by moving from an interior of the storage chamber toward an inner side wall of the storage chamber;

a lever performing a seesaw movement on a plane perpendicular to a moving direction of the button to press the switch as the button moves from the interior of the storage chamber toward the inner side wall of the storage chamber;

a case having an open front surface and an accommodating portion accommodating the switch;

a cover covering the open front surface of the case; and an elastic member surrounding an outer periphery of the button and connecting the button to the cover, the elastic member being co-planar with the cover, whereby removing an internal force applied to the button moves the button toward an interior of the storage chamber, wherein the dispenser is installed on the inner side wall of the storage chamber to be accessible as the door is open and the accommodating portion is located between a flat inner side wall and a flat outer side wall of the storage chamber.

5. The dispenser according to claim 4, wherein the lever is rotatably installed sideward with respect to the moving directions of the button having one end disposed at a rear side of the button and an other end disposed on the switch and performing a seesaw movement sideward as the button moves from the interior of the storage chamber toward the inner side wall of the storage chamber to press the switch.

6. The dispenser according to claim 4, further comprising a cam projection in communication with the button, the cam projection abutting against the lever and causing the lever to move in a sideward moving direction when the button is depressed.

7. The dispenser according to claim 4, further comprising a discharge line to discharge the water, the discharge line discharging water when the switch is pressed by the lever.

* * * * *